US005264813A

United States Patent [19]

Byers, Jr.

[11] Patent Number: 5,264,813

[45] Date of Patent: Nov. 23, 1993

[54] FORCE MOTOR HAVING TEMPERATURE COMPENSATION CHARACTERISTICS

[75] Inventor: J. Otto Byers, Jr., Kalamazoo, Mich.

[73] Assignee: Caterpillar Inc., Peoria, Ill.

[21] Appl. No.: 17,219

[22] Filed: Feb. 12, 1993

Related U.S. Application Data

[63] Continuation-in-part of Ser. No. 885,991, May 19, 1992.

[51] Int. Cl.[5] ..... H01F 41/00; H01F 7/00; H01F 7/08

[52] U.S. Cl. ..... 335/217; 335/229

[58] Field of Search ..... 335/217, 144, 229, 230, 335/234, 255, 281, 273, 258; 310/16; 251/129.01-129.22

[56] References Cited

U.S. PATENT DOCUMENTS

| | | | |
|---|---|---|---|
| 3,740,594 | 6/1973 | Casey | 310/30 |
| 3,947,794 | 3/1976 | Newcomb | 335/217 |
| 4,705,219 | 11/1987 | Pagdin | 239/397.5 |
| 4,793,372 | 12/1988 | Gauthier | 137/82 |

*Primary Examiner*—Leo P. Picard

*Assistant Examiner*—Raymond Barrera

*Attorney, Agent, or Firm*—David M. Masterson

[57] ABSTRACT

A force motor having a cylindrical armature of ferromagnetic material is provided. An electromagnetic coil is disposed coaxially around the armature. First and second cylindrical plates are disposed on opposite ends of the armature in spaced proximity from the armature forming a respective gap having a predetermined length. A substantially tubular permanent magnet is disposed coaxially around the armature. The magnet is magnetized radially with respect to the longitudinal axis and provides a pair of oppositely directed magnetic flux paths. A current source energizes the electromagnetic coil, which produces an electromagnetic flux path directed through the gaps and the armature to cause the armature to move. Advantageously, temperature compensators are provided to differentially expand and contract, with respect to the cylindrical plates, in response to a varying temperature of the force motor. The differential expansion of the temperature compensators urges the cylindrical plates toward one another to reduce the predetermined length of the gaps.

30 Claims, 2 Drawing Sheets

FORCE MOTOR HAVING TEMPERATURE COMPENSATION CHARACTERISTICS

This is a continuation-in-part of application Ser. No. 07/885,991, filed May 19, 1992.

DESCRIPTION

1. Technical Field

This invention relates generally to a force motor and, more particularly, to a force motor having temperature compensation characteristics.

2. Background Art

Typical hydraulic systems utilize pilot stages to control large directional control valves. It is also well known to use electrical actuated pilot valves. For example, electrical actuated valves usually have two solenoids, one positioned on either side of the valve, to provide actuation of the spool in two directions. Additionally, the pilot valve may exhibit characteristics which achieve proportional performance, i.e. spool movement which is proportional to an applied current. However, the use of two solenoids per valve makes for a costly and a physically large system.

Casey et al. in U.S. Pat. No. 4,605,197 assigned to Fema Corporation discloses a pilot valve having only one force motor. The force motor uses a permanent magnet. The permanent magnet allows the force motor to actuate the spool bi-directionally. However, the force motor design of Casey does present some problems.

For example, it is well known that permanent magnets temporarily lose a percentage of the magnetic force with increasing temperature. Ferritic magnets may lose up to 30% of the permanent magnet residual induction, which results in a 49% decrease in the magnetic force with a 100° C. increase in temperature. Even neodymium-type permanent magnets lose up to 7% of the permanent magnet residual induction, which results in a 14% reduction of the magnetic force with a temperature increase of 100° C. The change in magnetic force with increasing temperature of the permanent magnet results in poor valve performance. Thus, temperature compensation is needed to account for the magnetic force loss.

The present invention is directed to overcoming one or more of the problems as set forth above.

DISCLOSURE OF THE INVENTION

In one aspect of the present invention a force motor is disclosed. The force motor has a cylindrical armature of ferromagnetic material. An electromagnetic coil is disposed coaxially around the armature. First and second cylindrical plates are disposed on opposite ends of the armature in spaced proximity from the armature forming a respective gap having a predetermined length. A substantially tubular permanent magnet is disposed coaxially around the armature. The magnet is magnetized radially with respect to the longitudinal axis and provides a pair of oppositely directed magnetic flux paths. A current source energizes the electromagnetic coil, which produces an electromagnetic flux path directed through the gaps and the armature to cause the armature to move. Advantageously, temperature compensators are provided to differentially expand and contract, with respect to the cylindrical plates, in response to a varying temperature of the force motor. The differential expansion of the temperature compensators urges the cylindrical plates toward one another to reduce the predetermined length of the gaps.

BRIEF DESCRIPTION OF THE DRAWINGS

For a better understanding of the present invention, reference may be made to the accompanying drawings in which.

BEST MODE FOR CARRYING OUT THE INVENTION

Figure 1:
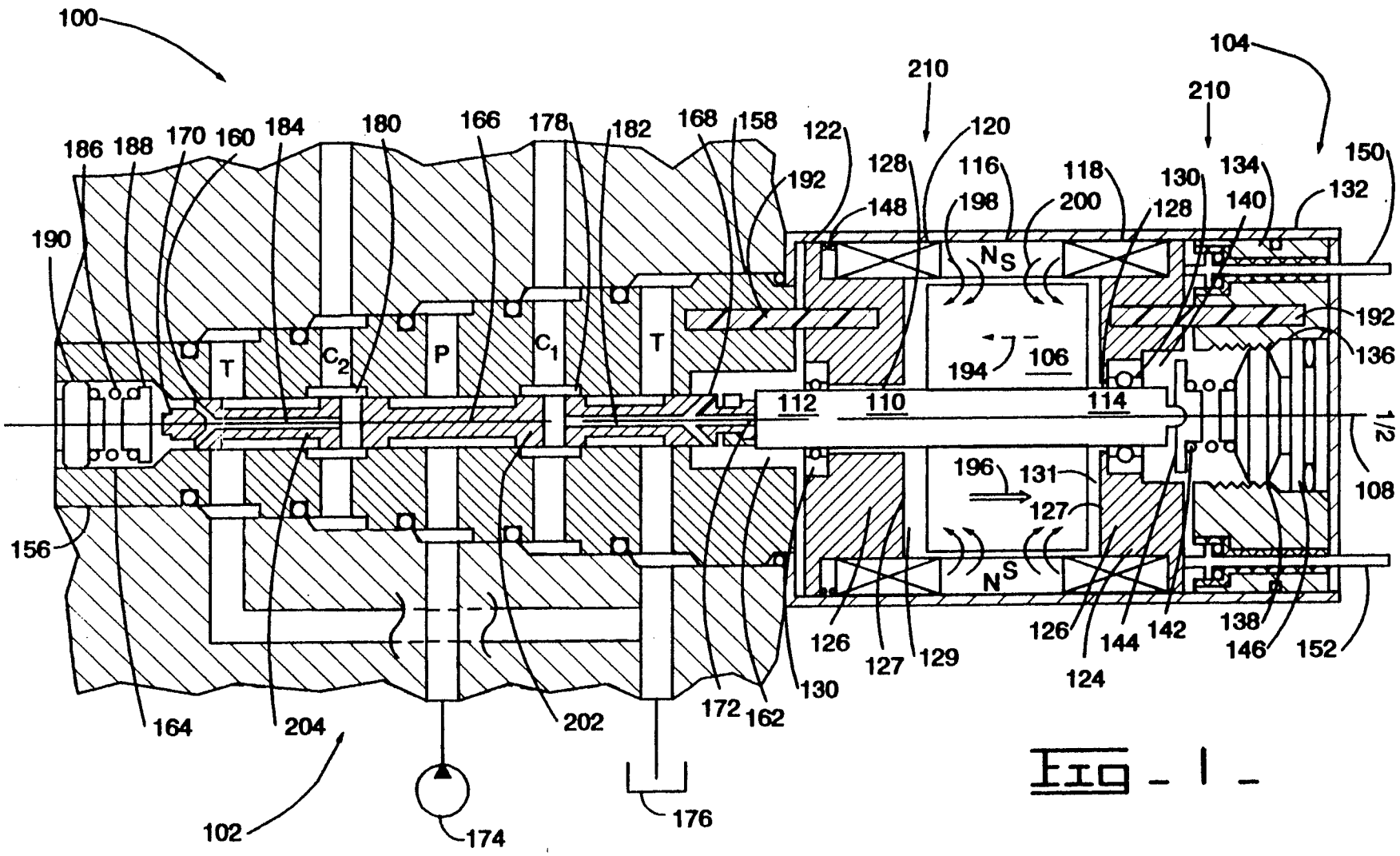
FIG. 1 illustrates a cross-sectional view of a proportional electro-hydraulic pressure control device in accordance with one embodiment of the present invention.

The present invention is well suited toward applications in hydraulic systems which require pilot stages. The present invention is shown in conjunction with reference to FIG. 1., which illustrates one embodiment of a proportional electro-hydraulic 4-way variable pressure device 100. The device 100 may form a pilot stage of a hydraulic system for controlling the movement of a main spool valve. The main spool valve may be used to control the flow of hydraulic fluid to a hydraulic motor, such as a hydraulic cylinder.

The device 100 is essentially comprised of two parts, a hydraulic valve assembly 102 and a force motor 104. The force motor 104 is a bi-directional electro-magnetic actuator. The force motor 104 includes a cylindrical armature 106 of ferromagnetic material bounded by a pair of ends. The armature 106 has a longitudinal axis 108 and is secured to a shaft 110 having first and second ends 112, 114. The shaft 110 is formed of a nonmagnetic material and extends axially from the ends of the armature 106. For example, the armature may have an internal diameter of 0.188 in. or 0.48 cm, an outside diameter of 0.930 in. or 2.36 cm and a length of 1.00 in. or 2.54 cm.

The armature 106 is surrounded by a permanent magnet 116. The permanent magnet 116 has an annular shape having a radial magnetization as noted by poles "N" and "S". The permanent magnet 116 may be made of a single tubular piece or several pieces of arcuate shape which, when assembled, is formed in a substantially tubular shape. The permanent magnet 116 has an integral surface which is closely spaced from an external surface of the armature 106. The permanent magnet 116 may be composed of a Ferrite material grade 7, for example. However, as is well known in the art many other types of permanent magnetic material may be used. For example, a neodymium permanent magnet may also be utilized. For example, the permanent magnet may have an internal diameter of 1.00 in. or 2.54 cm, an outside diameter of 1.63 in. or 4.14 cm and a length of 0.75 in. or 1.91 cm. As is well known, the dimensions of the permanent magnet are dependent upon the desired output force of the force motor.

First and second electromagnetic coils 118, 120 of annular shape are positioned on opposite ends of the permanent magnet 116. The coils 118, 120 are wound on a non-magnetic core (not shown) of substantial tubular shape. The two coils are electrically connected to one another. Although two coils are shown it is readily apparent that only a single coil may be provided.

Enclosing a combination of the armature 106, magnet 116, and coils 118, 120 are a pair of cylindrical plates 122, 124 of ferromagnetic material each having inwardly turned bosses 126 defining a journaled opening 128 for reception and support of the shaft 110. The bosses 126 of the cylindrical plates 122, 124 include respective pole pieces 127 which terminate the movement of the armature 106. Further, the respective pole pieces 127 of each plate 122, 124 are in spaced proximity of the armature 106 thereby forming respective air gaps 129, 131. The cylindrical plates 122, 124 each have ball bearings 130 disposed in the respective openings 128. A tubular housing or shell 132 encloses the combination and the cylindrical plates 122, 124.

The housing 132 includes a cylindrical end plug 134 disposed between a second cylindrical plate 124 and an end of the housing 132. The housing 132, like the cylindrical plates 122, 124, is made of ferromagnetic material. The housing 132 includes a first adjusting assembly 136 disposed in a bore 138. The journaled bore of the second cylindrical plate 124 and the bore 138 of the end plug 134 define a working chamber 140. A first adjustable spring 142 having a retainer 144 is disposed in the working chamber 140 Although a coiled spring is shown one skilled in the art can recognize that a leaf or "S" spring may equally be used. The first adjusting assembly 136 is screw-mounted into the bore 138. The first adjusting assembling 136 may include an O-ring seal 146 to prevent contaminants from entering and/or hydraulic oil from exiting the force motor 104. The position of the first adjustable spring 142 is set such that the retainer 144 contacts the second end 114 of the shaft 110 via the first adjusting assembly 136.

An annular, coiled spring 148 is positioned between the second coil 120 and a first cylindrical plate 122. The spring 148 preloads the combination of the coils 118, 120, magnet 116, and cylindrical plates 122, 124. Further, the spring 148 separates the first and second cylindrical plates 122, 124 in variable position. For example, the separation of the cylindrical plates 122, 124 may provide for a combined length of the air gaps 129, 131 to be 0.080 in. or 0.20 cm at 100° C. In the preferred embodiment the spring preload is at least equal to or greater than the maximum force output of the force motor 104.

A pair of electrical connectors 150, 152 are attached to the first and second coil 118, 120. The electrical connectors 150, 152 supply electrical energy via a current source (not shown) to the coils 118, 120.

Accordingly the hydraulic valve assembly 102 consists of a valve body 156 which is affixed through an adapter 158 to the housing 132. The valve body includes a central bore 160 which is axially aligned with the longitudinal axis 108. Further, the central bore defines first and second chambers 162, 164 at opposite ends of the central bore 160.

The valve body 156 includes a linearly shiftable spool 166 having first and second ends 168, 170. The spool 166 is disposed in the central bore 160 with the first end 168 of the spool 166 being connected to the first end 112 of the shaft 110 via a mechanical coupling 172. The spool 166 has a plurality of axially spaced lands separated by annular grooves.

The valve body 156 has several ports, including two fluid exhaust ports T, two fluid control ports $C_1$, $C_2$, and a fluid supply port P. The fluid supply port P is connected to a pressure source 174 and supplies a pressurized fluid to the central bore 160 via radially extending bores. The fluid control ports $C_1$, $C_2$ are connected to a load, such as a main valve or hydraulic motor, and the fluid exhaust ports are connected to a tank 176.

The first and second control ports $C_1$, $C_2$ each define an annulus 178, 180. Additionally, the spool 166 defines a first longitudinally extending passage 182 communicating fluid from the annulus 178 of the first control port $C_1$ to the first chamber 162. Finally, the spool 166 defines a second longitudinally extending passage 184 communicating fluid from the annulus 180 of the second control port $C_2$ to the second chamber 164. Moreover, it may be apparent to those skilled in the art that the annulus may be in the form of a drilled hole, for example.

The valve body 156 includes a second adjustable spring 186, similar to the first adjustable spring 142, having a retainer 188 disposed in the second chamber 164. The valve body 156 further includes a second adjusting assembly 190 similar to the first adjusting assembly 136 such that the second adjusting assembly 190 adjusts the retainer 188 to the second end 170 of the spool 166.

It should be noted that the force rate of the springs 142, 186 are higher than the force rate of the permanent magnet 116. Therefore, the springs 142, 186 prevents the armature 106 from "latching" to its maximum travel position due to the permanent magnetic force.

Advantageously the device 100 includes a temperature compensator means 210. For example, the temperature compensator means 210 may include a plurality of rods 192 composed of plastic, aluminum or any other highly thermally expansive material. For example, the rods 192 may consist of a highly expansive plastic material with a thermal coefficient of $12*10^{-5}/°C$. The high thermal coefficient nature of the rod material allows the rods 192 to expand at a much higher rate than the steel parts of the motor 104. More particularly, each rod 192 has a predetermined length of 0.990 at 100° C., for example. The rods are longitudinally positioned in equal spacing about the longitudinal axis 108. More particularly, the adapter 158 and the first cylindrical plate 122 include three longitudinally extending bores spaced 120° about the longitudinal axis 108. Also, the end plug 134 and the second cylindrical plate 124 include three longitudinal extending bores spaced 120° about the longitudinal axis 108. Each of the longitudinal extending bores include a rod 192. The rods 192 load the cylindrical plates 122, 124 against the force of the spring 148. Further, as may be readily apparent to those skilled in the art, the rods 192 may be in other shapes or forms—such as a disk, for example.

Figure 2:
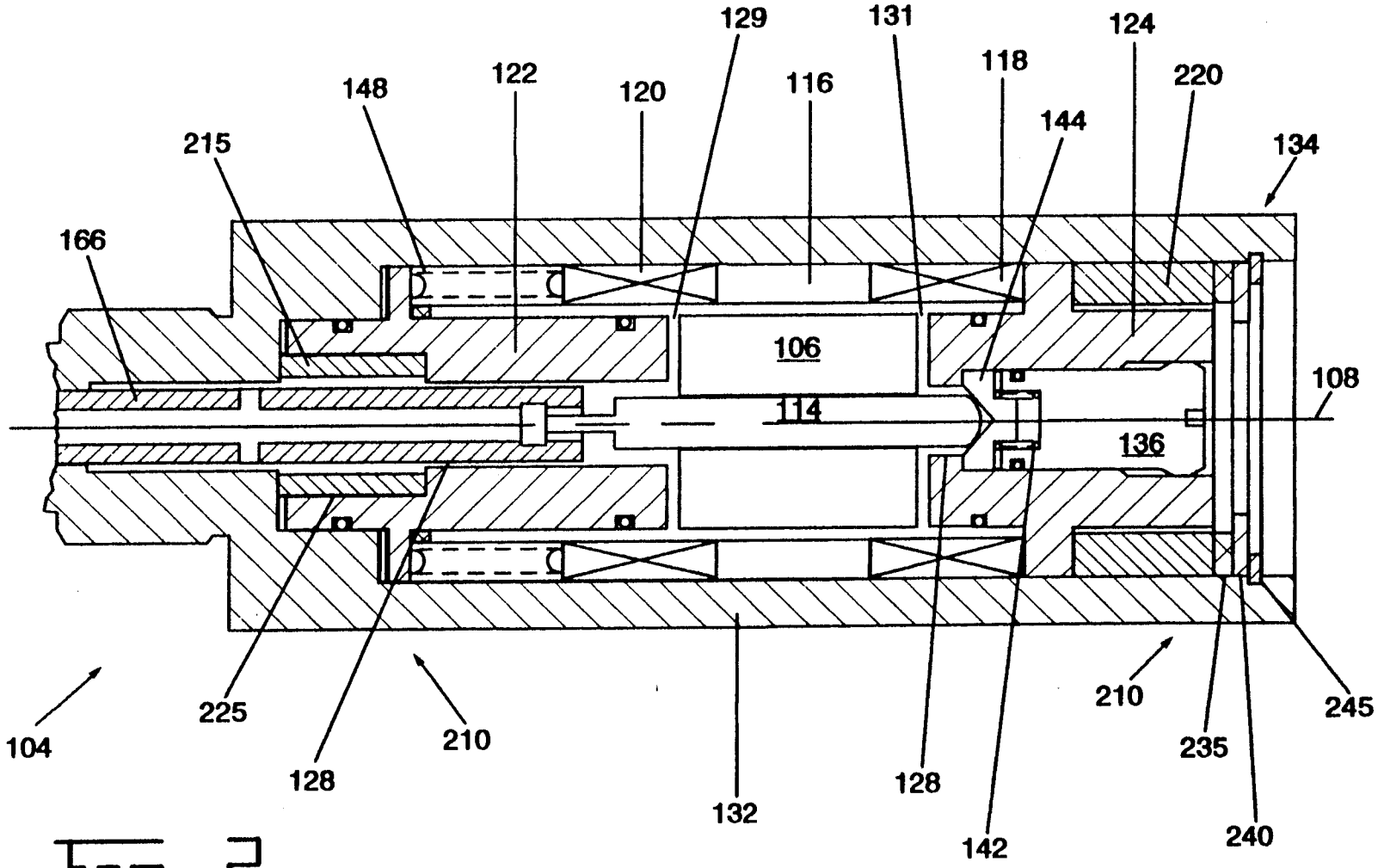
FIG. 2 illustrates a cross-sectional view of a proportional electro-hydraulic pressure control device in accordance with another embodiment of the present invention.

Referring now to FIG. 2, another embodiment of the present invention is shown. For simplicity, the same reference numerals are used to describe the same elements as those appearing in FIG. 1, and a detailed description of such elements is omitted. Not shown, is a copper alloy tube disposed around the armature 106. The copper alloy tube may replace the bearings 130 of the prior embodiment, thus supporting the armature 106. The copper alloy tube may also seal the coil 118, 120 and permanent magnet 116 from hydraulic fluid.

Here, the temperature compensator means 210 includes first and second expansive tubes 215, 220 disposed coaxially about the longitudinal axis 108 and contiguous to the first and second cylindrical plates 122, 124, respectively. As shown, the first cylindrical plate 122 defines a counter bore 225 disposed about the central opening 128 on an end opposite the boss 126. The first expansive tube 215 resides within the counter bore 225. The second tube 220 is positioned adjacent the second cylindrical plate 124 and the end plug 134. Here, the end plug includes a spacer 235, a shim 240 and a snap ring 245.

The temperature compensator means 210 may be comprised of a high strength plastic material manufactured by General Electric as product no. ULTEM 1000. This material is suitable to provide the required expansion over a 100° C. temperature range to compensate for changes in the permanent magnetic flux. The thermal coefficient of this material is $5.6*10^{-5}/°C$.

The relative dimensions of temperature compensator means 210 will now be discussed. As is well known in the art, a permanent magnet made of ferrite material loses a greater amount of flux over a predetermined temperature range than does a permanent magnet made of neodymium material. Therefore, the dimensions of the temperature compensator means 210 will vary depending upon the permanent magnetic material utilized. The following dimensions are illustrative in nature and are suitable for the size and type of force motor discussed. The dimensions are given relative to 100° C.

A force motor having ferrite permanent magnetic material of grade 7 may include a first tube 215 with an outer diameter (OD) of 1.437 in. or 36.450 mm, an inner diameter (ID) of 0.922 in. or 23.419 mm and a length of 1.001 in. or 25.425 mm. The second tube 220 may have an OD of 0.559 in. or 14.199 mm, an ID of 0.375 in. or 9.525 mm and a length of 1.000 in. or 25.400 mm. This particular permanent magnet arrangement is adapted to produce a force output of about 105 Newtons at 100° C.

A force motor comprising neodymium permanent magnetic material may include a first tube 215 with an OD of 1.437 in. or 36.450 mm, an ID of 0.930 in. or 23.622 mm and a length of 0.505 in. or 12.827 mm. The second tube 220 may have an OD of 0.560 in. or 14.224 mm, an ID of 0.375 in. or 9.525 mm and a length of 0.520 in. or 13.208 mm. This particular permanent magnet arrangement is adapted to also produce a force output of about 105 Newtons at 100° C.

As is well known in the art, the magnitude of permanent magnetic flux changes with temperature. Also as is well known, the magnitude of the magnetic flux is inversely proportional to the air gap length. Therefore if the thermal coefficient of the temperature compensator means 230, the characteristics of the permanent magnet with respect to temperature, and the length of the air gap are known, then the relative dimensions of the temperature compensator means 230 can readily be calculated to produce a desired expansion that results in a constant magnetic flux for all types and sizes of force motors. Further as would be evident to those skilled in the art, the present invention is not only suited to provide temperature compensation for magnetic flux of linear force motors but also suited to provide temperature compensation for magnetic flux of rotary force motors.

Finally, the present invention is also well suited toward compensating for the resistive changes of a coil as the temperature changes. As is well known in the art, the electromagnetic flux produced by a coil is inversely proportional to the resistance of a coil—assuming a constant applied current or voltage. Thus it may be desirable to compensate for changes in the resistance of a coil, where the change in the resistance is due to temperature changes.

The change in electromagnetic flux due to resistive changes of a coil, is greater than the change in permanent magnetic flux over a predetermined temperature range. Thus, the relative dimensions of the temperature compensator means 210 described above may be modified to compensate for changes in coil resistance due to temperature. The temperature compensator means 210 described below not only compensates for changes in the coil resistance but also for changes in the permanent magnetic flux.

For example it may be desirable to manufacture the temperature compensator means 210 from a graphite-filled, teflon material. For example, a suitable material is manufactured by Enflo Corporation as composite 4022. The thermal coefficient of this material is $10.6*10^{-5}/°C$.

One example is discussed below. The first tube 215 may have an OD of 1.437 in. or 36.45 mm, an ID of 0.930 in. or 23.419 mm and a length of 1.25 in. or 31.175 mm. The second tube 220 may have an OD of 0.560 in. or 14.225 mm, an ID of 0.375 in. or 9.525 mm and a length of 1.25 in. or 31.175 mm. The above dimensions are suitable for a force motor having an electromagnetic coil that produces a force of 105 Newtons at a current of 0.6 Amps. Additionally, the coil resistance of the illustrated force motor is 17.9 Ohms at 100° C.

The dimension described herein are for exemplary purposes only, and the actual dimensions will depend upon the design characteristics of the force motor.

INDUSTRIAL APPLICABILITY

To best illustrate the advantages of the present invention an example of the device operation will now be described.

When a current of positive magnitude is applied to the coils 118, 120, the coils 118, 120 energize producing a flux current as indicated by the dashed arrow 194 moving through the armature 106 toward the left, as viewed in FIG. 1, across the first air gap 129 and the pole piece 127 of the first cylindrical plate 122 and returning toward the right through the housing 132 and the second cylindrical plate 124 across the second air gap 131 and back through the armature 106. Conversely, a current of negative magnitude applied to the coils 118, 120, produces a flux current as indicated by the double shafted arrow 196 moving through the armature 106 toward the right, as viewed in FIG. 1, across the second air gap 131 and the pole piece 127 of the second cylindrical plate 124 and returning toward the left through the housing 132 and the first cylindrical plate 122 across the first air gap 129 and back through the armature 106. For example, the force motor produces a force output of 25 lbs. with a current of 0.6 Amps.

The permanent magnet 116, being a radially magnetized magnet, produces a permanent magnetic flux which moves in paths 198, 200 from the center of the motor 104 across the air gaps 129, 131 toward the respective pole pieces 127 of the cylindrical plate 122, 124 and back through the housing 132 so as to form two cylindrical flux paths. As a consequence, when the electromagnetic coils 118, 120 are not energized, the armature 116 is directionally bi-stable in that it will be attracted toward the closest pole piece 127 due to the net magnetic attraction in that direction caused by the lower reluctance in the air gap 129, 131 having the smallest length. The flux density from the permanent magnet 116 is equal to or greater than ½ of the maximum combined flux density of the permanent magnet and electromagnet.

The device 100 has two "neutral" positions. That is, when the electromagnetic coils 188, 120 are not energized pressure forces in the chambers of the device sufficiently counterbalance the forces of the permanent magnet 116, positioning the spool 166 at one of two "neutral" positions. Advantageously, a neutral position causes a minimum fluid pressure in one of the control ports $C_1$,$C_2$.

Upon applying negative current to the force motor 104, a pilot pressure is generated proportional to the applied current. For example, upon energizing the coils 118, 120 in a negative direction the electromagnetic flux path moves in the direction of the arrow 196 aiding the permanent magnetic flux path 200 while weakening the permanent magnetic flux path 198, immediately forcing the armature 116 to the right achieving a desired fluid pressure in the control port $C_1$.

Upon applying positive current to the force motor 104, the electromagnetic flux moves in the direction of the arrow 194 which reenforces the permanent magnetic flux path 198 while weakening the flux path 200, thereby forcing the armature 116 along with the spool 166 to shift proportionally to the left to achieve a desired fluid pressure in the control port $C_2$.

Advantageously, the force motor 104 includes temperature compensation characteristics to control the changing permanent magnetic flux. As is well known, permanent magnets temporarily lose a percentage of its magnetic flux with increasing temperature. It is also well known that the permanent magnet flux may be inversely proportional to the length of the air gap. Thus if the length of the air gap is caused to change proportionally with temperature, the permanent magnet flux density may remain substantially constant.

For example as the temperature of the motor 104 increases, the length of the rods 192 or tubes 215, 220 increases proportionally. Naturally, the change in length is dependent upon the dimensions of the temperature compensator means 210 and the thermal coefficient of the material utilized. The extension of the rods 192 or tubes 215, 220 compresses the annular spring 148 to cause the cylindrical plates 122, 124 to move toward one another, thereby decreasing the length of each air gap 129, 131 in proportion to the linear extension of the rods 192 or tubes 215, 220. Further as the temperature of the motor 104 decreases, the length of the rods 192 or tubes 215, 220 decreases proportionally. For example, the annular spring 148 biases the cylindrical plates 122, 124 away from each other to increase the predetermined length of the gaps 129, 131 in response to the rods 192 or tubes 215, 220 contracting. Advantageously, the flux density of the permanent magnetic circuit remains substantially constant, even though the temperature of the force motor 104 changes.

It should be noted that, changes in the working air gap significantly affects the magnetic circuit flux when:

(1) the total magnetic circuit reluctance is low, 0.10 for example; and (2) the circuit flux in the air gap is nearly proportional to the permanent magnetic residual induction.

The above discussion is directed towards compensating for the change in permanent magnetic flux vs. temperature of the permanent magnet to achieve a substantially constant permanent magnetic flux density. However, the present invention may also be utilized to compensate for changes in the electromagnetic flux vs. changes in the resistance of the coil due to varying coil temperature to achieve a constant flux density.

Other aspects, objects and advantages of the present invention can be obtained from a study of the drawings, the disclosure and the appended claims.

I claim:

1. A force motor, comprising:

a cylindrical armature of ferromagnetic material;

a first electromagnetic coil being disposed about said armature;

first and second cylindrical plates being in spaced proximity from the armature forming a respective gap having a predetermined length;

a current source being connected to said first electromagnetic coil and adapted to energize said electromagnetic coil, said energized coil producing an electromagnetic flux path directed through the gaps and said armature causing said armature to move;

a housing having ferromagnetic material, said housing being adapted to enclose said first electromagnetic coil, and cylindrical plates; and temperature compensator means for differentially expanding and contracting with respect to the cylindrical plates in response to a varying temperature of the force motor, the differential expansion of the temperature compensator means urging the cylindrical plates toward one another to reduce the predetermined length of the gaps.

2. A force motor, as set forth in claim 1, including an annular spring disposed between said permanent magnet and first cylindrical plate, the differential contraction of said temperature compensator means provides for said annular spring to bias the cylindrical plates away from each other to increase the predetermined length of the gaps.

3. A force motor, as set forth in claim 1, wherein the magnitude of the electromagnetic flux passing through a respective gap is substantially constant with a constant voltage drop across the electromagnetic coil and with a varying temperature of the force motor.

4. A force motor, as set forth in claim 3, including a substantially tubular permanent magnet having an internal cylindrical surface and an external cylindrical surface and being disposed coaxially around said armature, the internal surface being closely spaced from said armature, said magnet being magnetized radially said magnet providing a pair of oppositely directed magnetic flux paths.

5. A force motor, as set forth in claim 2, wherein the permanent magnet flux paths travel through a respective gap, the magnitude of the permanent magnetic flux and electromagnetic flux in a respective gap provides a substantially constant force with a constant voltage drop across the electromagnetic coil and with a varying temperature of the force motor.

6. A force motor, as set forth in claim 5, wherein the permanent magnet is comprised of ferrite material of grade 7.

7. A force motor, as set forth in claim 5, wherein the permanent magnet is comprised of a neodymium type material.

8. A force motor, as set forth in claim 7, wherein said armature moves linearly in first and second directions with respect to said coil in response to said coil being energized.

9. A force motor, as set forth in claim 8, wherein said temperature compensator means includes first and second tubes having an internal and external cylindrical surface and being composed of highly thermal expansive material.

10. A force motor, as set forth in claim 9, wherein said first cylindrical plate defines a counter bore the first tube being disposed within the counter bore of said first cylindrical plate.

11. A force motor, as set forth in claim 10, wherein the second tube is disposed coaxially around said second cylindrical plate with the internal surface of said second tube being closely spaced from said second cylindrical plate.

12. A force motor, as set forth in claim 11, including a second electromagnetic coil disposed between said annular spring and said permanent magnet, said second electromagnetic coil being electrically connected to said first electromagnetic coil.

13. A force motor, as set forth in claim 12, wherein said annular spring is adapted to bias the combination of said second coil, permanent magnet, first electromagnetic coil, second cylindrical plate and said second expansive tube against one end of said housing, and said first cylindrical plate and first expansive tube against the other end of the housing.

14. A force motor, as set forth in claim 13, wherein the compressive force of the annular spring is equal to or greater than the maximum combined force of the permanent magnetic flux and the electromagnetic flux.

15. A force motor, as set forth in claim 8, wherein said temperature compensator means includes a plurality of rods composed of thermally expansive material having a predetermined length and being equally spaced from each other each rod being disposed within one of said cylindrical plates.

16. A force motor, comprising:

a cylindrical armature of ferromagnetic material;

a first electromagnetic coil being disposed about said armature;

first and second cylindrical plates having opposed ends and being disposed on opposite ends of said armature, the cylindrical plates being in spaced proximity from the armature forming a respective gap having a predetermined length;

a current source being connected to said first electromagnetic coil and adapted to energize said electromagnetic coil, said energized coil producing an electromagnetic flux path directed through the gaps and said armature causing said armature to move;

a permanent magnet providing a pair of oppositely directed magnetic flux paths;

a housing having ferromagnetic material, said housing being adapted to enclose said first electromagnetic coil, permanent magnet and cylindrical plates; and temperature compensator means for differentially expanding and contracting with respect to the cylindrical plates in response to a varying temperature of the force motor, the differential expansion of the temperature compensator means urging the cylindrical plates toward one another to reduce the predetermined length of the gaps.

17. A force motor, as set forth in claim 16, including an annular spring disposed between said permanent magnet and first cylindrical plate, the differential contraction of said temperature compensator means provides for said annular spring to bias the cylindrical plates away from each other to increase the predetermined length of the gaps.

18. A force motor, as set forth in claim 17, wherein the permanent magnet flux paths travel through a respective gap, the magnitude of the permanent magnetic flux in a respective gap being substantially constant with varying temperature of the force motor.

19. A force motor, as set forth in claim 17, wherein the permanent magnet flux paths travel through a respective gap, the magnitude of the permanent magnetic flux and electromagnetic flux in a respective gap provides a substantially constant force with a constant voltage drop across the electromagnetic coil and with a varying temperature of the force motor.

20. A force motor, as set forth in claim 17, wherein the permanent magnet flux paths travel through a respective gap, the magnitude of the permanent magnetic flux and electromagnetic flux in a respective gap is substantially constant with a constant current applied to the electromagnetic coil and with a varying temperature of the force motor.

21. A force motor, as set forth in claim 20, wherein the permanent magnet is comprised of ferrite material of grade 7.

22. A force motor, as set forth in claim 20, wherein the permanent magnet is comprised of a neodymium type material.

23. A force motor, as set forth in claim 22, wherein said armature moves linearly in first and second directions with respect to said coil in response to said coil being energized.

24. A force motor, as set forth in claim 23, wherein said temperature compensator means includes first and second tubes having an internal and external cylindrical surface and being composed of highly thermal expansive material.

25. A force motor, as set forth in claim 24, wherein said first cylindrical plate defines a counter bore the first tube being disposed within the counter bore of said first cylindrical plate.

26. A force motor, as set forth in claim 25, wherein the second tube is disposed coaxially around said second cylindrical plate with the internal surface of said second tube being closely spaced from said second cylindrical plate.

27. A force motor, as set forth in claim 26, including a second electromagnetic coil disposed between said annular spring and said permanent magnet, said second electromagnetic coil being electrically connected to said first electromagnetic coil.

28. A force motor, as set forth in claim 27, wherein said annular spring is adapted to bias the combination of said second coil, permanent magnet, first electromagnetic coil, second cylindrical plate and said second expansive tube against one end of said housing, and said first cylindrical plate and first expansive tube against the other end of the housing.

29. A force motor, as set forth in claim 28, wherein the compressive force of the annular spring is equal to or greater than the maximum combined force of the permanent magnetic flux and the electromagnetic flux.

30. A force motor, as set forth in claim 23, wherein said temperature compensator means includes a plurality of rods composed of thermally expansive material having a predetermined length and being equally spaced from each other each rod being disposed within one of said cylindrical plates.

* * * * *

UNITED STATES PATENT AND TRADEMARK OFFICE

CERTIFICATE OF CORRECTION

PATENT NO. : 5,264,813

DATED : November 23, 1993

INVENTOR(S) : J. Otto Byers, Jr.

It is certified that error appears in the above-identified patent and that said Letters Patent is hereby corrected as shown below:

Claim 2, column 8, line 30, delete "1" and insert --4--.

Claim 4, column 8, line 47, after "radially" insert --,--.

Claim 15, column 9, line 33, after "other" insert --,--.

Claim 16, column 9, lines 39-41, please delete "having opposed ends and and being disposed on opposite ends of said armature, the cylindrical plates".

Claim 25, column 10, line 38, after "bore" insert --,--.

Claim 30, column 10, line 66, after "other" insert --,--.

Signed and Sealed this

Third Day of May, 1994

Bruce Lehman

*Attest:*

BRUCE LEHMAN

*Attesting Officer*

*Commissioner of Patents and Trademarks*